US005529249A

United States Patent [19]

Braun et al.

[11] Patent Number: 5,529,249

[45] Date of Patent: Jun. 25, 1996

[54] ROTARY IMPACT BREAKER WITH REPLACEABLE JAWS

[75] Inventors: Gert Braun; Ernst Braun, both of Essen, Germany

[73] Assignee: Westfalia & Braun Zerkleinerungstechnik GmbH & Co., Lunen, Germany

[21] Appl. No.: 330,707

[22] Filed: Oct. 28, 1994

[30] Foreign Application Priority Data

Nov. 10, 1993 [DE] Germany ..... 43 38 331.9

[51] Int. Cl.[6] ..... B02C 13/06; B02C 13/28

[52] U.S. Cl. ..... 241/32; 241/189.1; 241/191; 241/195; 241/300

[58] Field of Search ..... 241/189.1, 191, 241/195, 197, 300, 32

[56] References Cited

U.S. PATENT DOCUMENTS

| | | | |
|---|---|---|---|
| 3,454,234 | 7/1969 | Schoeppner | 241/189.1 X |
| 3,847,362 | 11/1974 | Lowe et al. | 241/191 |
| 3,876,159 | 4/1975 | Kidd | 241/32 |
| 3,944,147 | 3/1976 | Pletcher | 241/60 |
| 3,979,078 | 9/1976 | Boddeker et al. | 241/191 |
| 4,039,151 | 8/1977 | Coxhill et al. | 241/191 |
| 5,381,976 | 1/1995 | Chon et al. | 241/197 |

*Primary Examiner*—John Husar
*Attorney, Agent, or Firm*—Herbert Dubno; Andrew Wilford

[57] ABSTRACT

A rotary impact breaker has a housing and a rotor rotatable in the housing about an axis in a predetermined direction and formed with a radially outwardly open pocket having a generally radially extending front and back faces. An impact element has a foot part seated in the pocket and having a front face bearing against the front pocket face and a back face confronting and diverging from the back pocket face and a head part projecting radially from the pocket. A retaining wedge in the pocket has a front face bearing forwardly against the back element face and a back face backwardly against the back pocket face. A bolt engages radially from the wedge into the rotor and presses the wedge radially inwardly and thereby tightly lodges the wedge between the back element face and back pocket face.

10 Claims, 4 Drawing Sheets

ROTARY IMPACT BREAKER WITH REPLACEABLE JAWS

FIELD OF THE INVENTION

The present invention relates to a rotary impact breaker. More particularly this invention concerns such a breaker having removable and replaceable jaws.

BACKGROUND OF THE INVENTION

A standard rotary impact breaker or crusher has a housing forming a breaker surface and a rotor that rotates about an axis in the housing and that is provided with a plurality of impact elements that strike the material to be comminuted to break it directly, throw it against a breaker surface, or crush it. Typically the rotor is generally cylindrical and the impact elements are bolted radially to its outer surface.

Such an apparatus is used to comminute bulky hard items such as building debris, slag, smelting residue, and the like. Thus the impact element are subjected to enormous stresses which can break them and/or break the bolts securing them to the rotor. When damaged it is fairly common for the element to fly off the rotor, leaving the surface it was mounted on exposed and subject to damage by the normally rough and hard material being comminuted.

When an element-mounting surface of a rotor is damaged it is necessary to remove the entire rotor from the machine so that the damaged surface can be machined and refinished. This is clearly a very onerous job entailing substantial down time.

OBJECTS OF THE INVENTION

It is therefore an object of the present invention to provide an improved rotary impact breaker.

Another object is the provision of such an improved rotary impact breaker which overcomes the above-given disadvantages, that is which is easier to maintain than the prior-art such machines.

SUMMARY OF THE INVENTION

A rotary impact breaker has according to the invention a housing and a rotor rotatable in the housing about an axis in a predetermined direction and formed with a radially outwardly open pocket having generally radially extending front and back faces. An impact element has a foot part seated in the pocket and having a front face bearing against the front pocket face and a back face confronting and diverging from the back pocket face and a head part projecting radially from the pocket. According to the invention a retaining wedge in the pocket has a front face bearing forwardly against the back element face and a back face backwardly against the back pocket face. A bolt engages radially from the wedge into the rotor and presses the wedge radially inwardly and thereby tightly lodges the wedge between the back element face and back pocket face.

Thus the surfaces that support the impact element are relatively protected and will therefore not be damaged even if the element and/or its bolt are broken. If, as is common, the head breaks off the impact element, all that will be exposed is the removable wedge so that even if it is damaged, replacement is easy, not entailing the pulling of the entire rotor. Refitting costs for such a crusher are therefore reduced. In addition a solid impact element, that is one formed without throughgoing holes, can be used which is much stronger than the pierced prior-art units.

According to the invention the back pocket and wedge faces are formed with a radially extending and interengaging ridge and groove. Similarly the front wedge and back element faces are formed with a radially extending and interengaging ridge and groove. In addition the pocket has a radially outwardly directed base face and the element has a base face radially inwardly engaging the pocket base faces. The base faces are formed with an angularly extending and interengaging ridge and groove. These interengaging ridges and grooves therefore solidly anchor the wedge and impact element in the rotor, preventing any axial movement while radial outward movement is blocked by the bolt.

In accordance with a further feature of the invention the front pocket face is formed with a backwardly open undercut and the element is formed on its front face with a forwardly projecting ridge engaging in the undercut. This further anchors the element in place so that all radially outwardly effective force is not transmitted to the mounting bolt.

The element according to the invention is formed radially outside the pocket with a weakening groove. Thus if it does break, it will do so outside the rotor and not expose any hard-to-service surfaces of the pocket. This weakening groove extends generally parallel to the axis and is cut into the front element face.

According to yet another feature of the invention the rotor is formed radially inward of the wedge with an axially extending bore and with a radially extending bore between the axial bore and the pocket. The wedge is formed with a radially throughgoing bore aligned with the radial rotor bore. The rotor includes an anchor rod loosely received in the axial bore and formed with a threaded bore aligned with the radial bores of the rotor and wedge. The bolt is engaged through the radial bores of the rotor and wedge and is threaded into the threaded bore of the anchor rod. Thus it is even possible to change the rod that the bolt is seated in.

The rotor is a disk as seen axially from the end shaped like a ram's horn or nautilus with a spiral-shaped outer surface. The pocket is located at the region of radius change.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
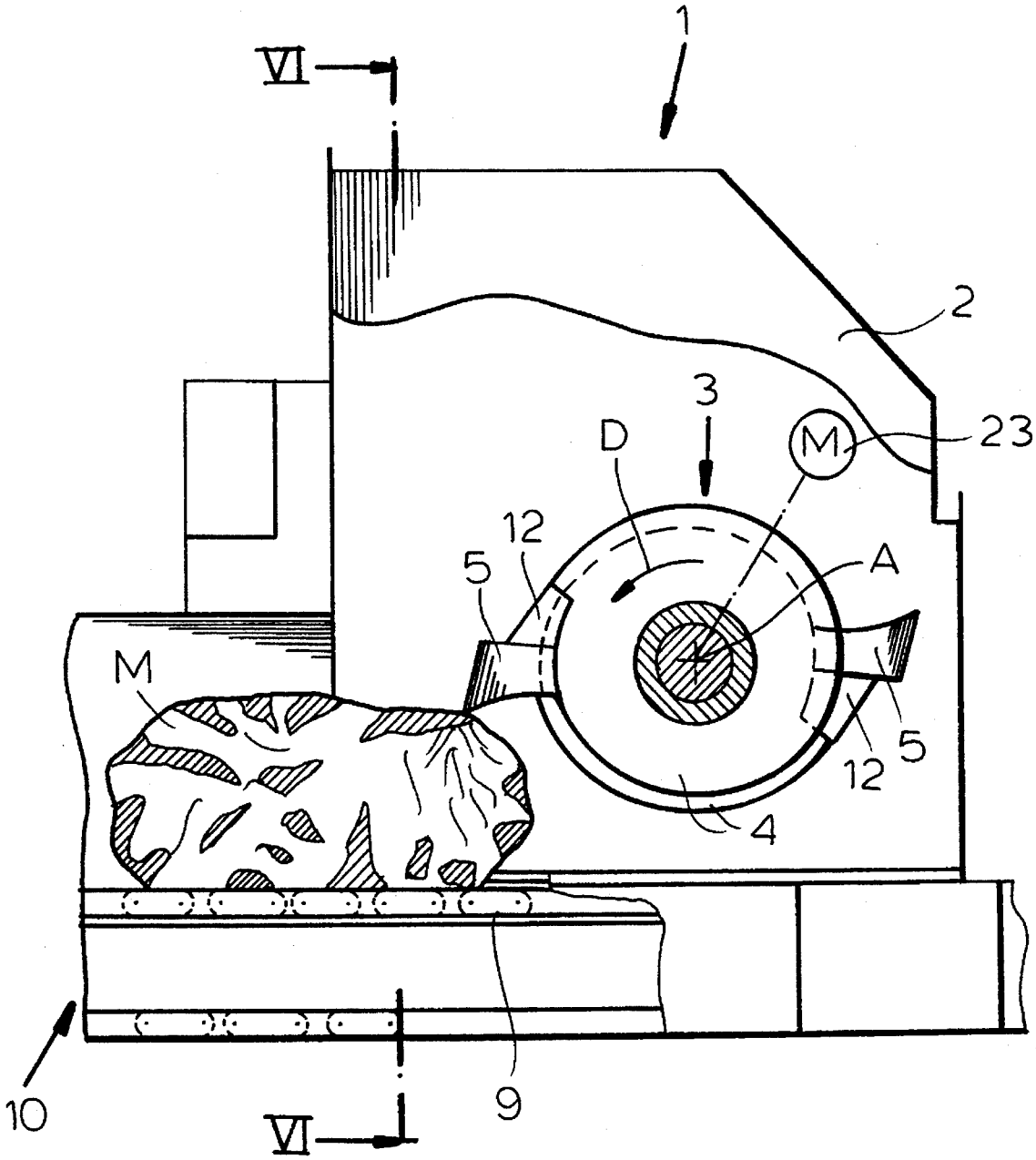
FIG. 1 is a partly diagrammatic and sectional side view of a rotary impact breaker according to the invention.
Figure 6:
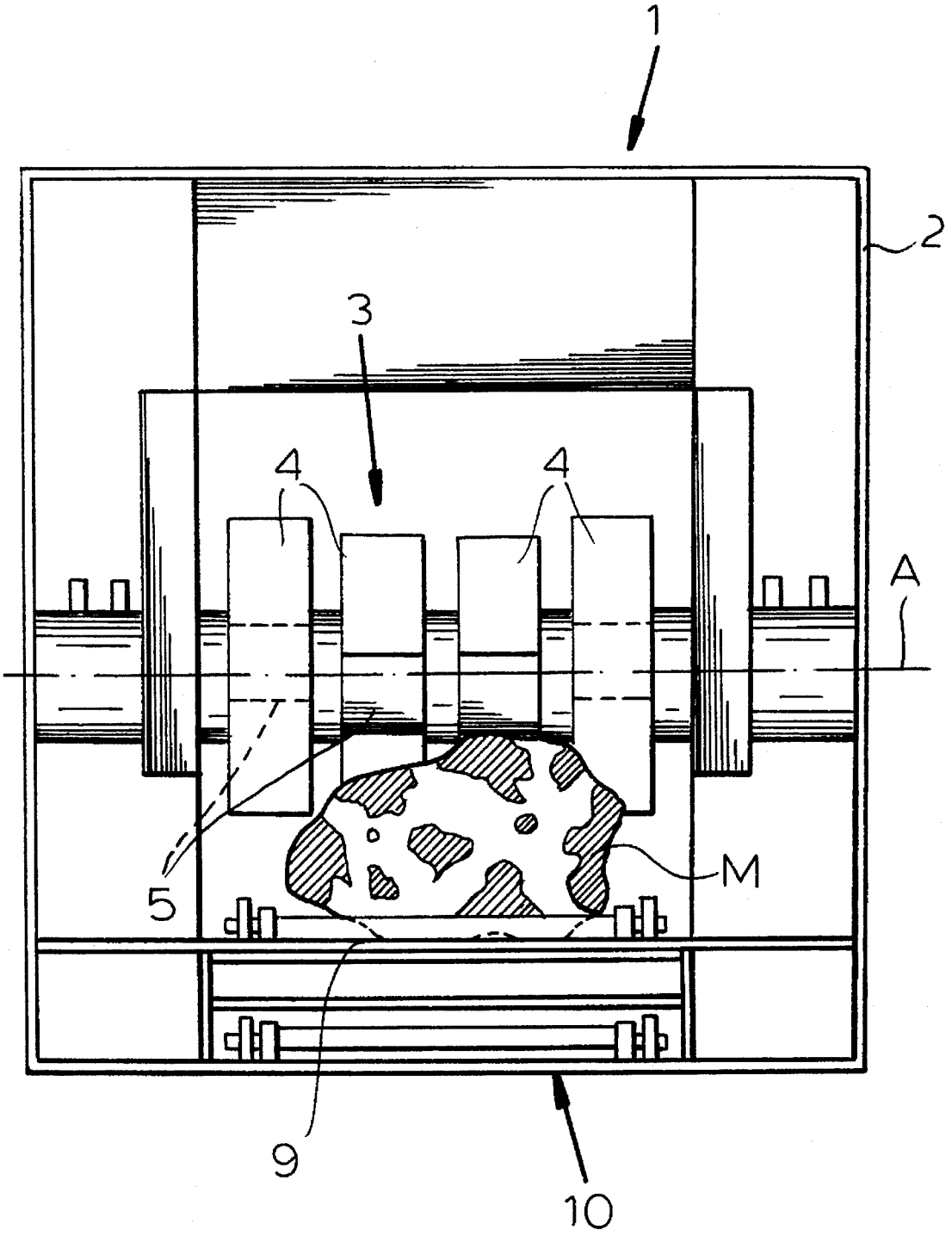
FIG. 6 is a cross section taken along line VI—VI of FIG. 1.

As seen in FIGS. 1 and 6 an impact breaker 1 according to the invention has a housing 2 in which a rotor 3 is rotatable about an axis A. The rotor 3 has a plurality of arms or sections 4 each provided with a respective impact element or head 5 and is rotated about its axis A in the direction D by a motor illustrated schematically at 23.

Blocks M of material to be comminuted are advanced inward by a conveyor 10 forming a breaker surface 9 to the rotor 3. The rapidly moving elements 5 strike the material M, breaking it directly and crushing it against the surface 9.

Figure 2:
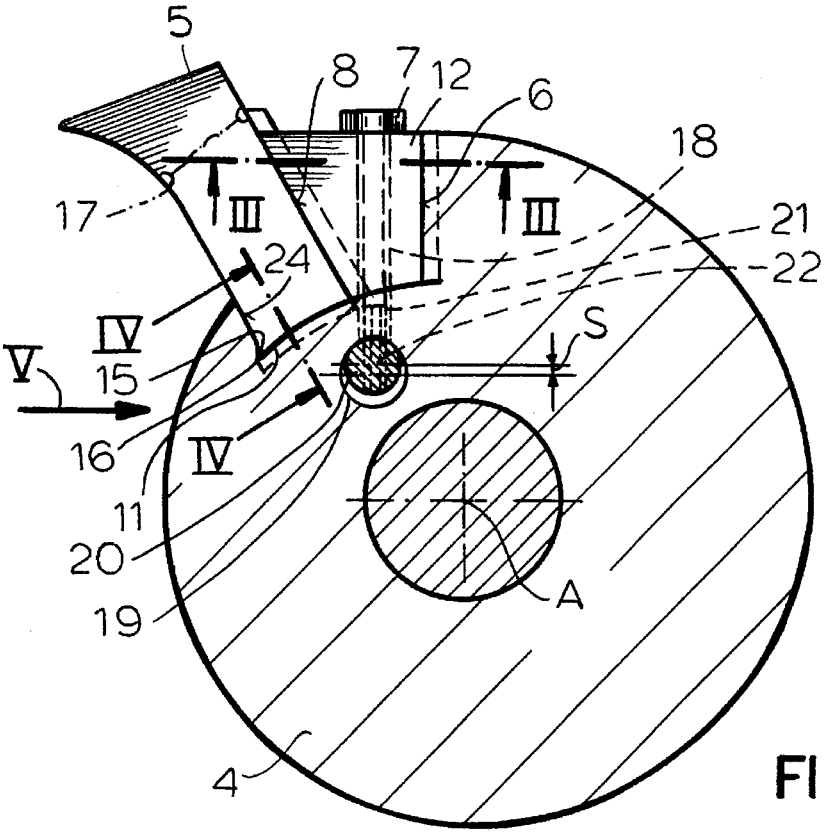
FIG. 2 is a larger-scale section through the rotor of the breaker of FIG. 1.

According to the invention as better seen in FIG. 2 each section 4 of the rotor 3 is formed with a radially outwardly open pocket 11 having a forwardly facing back face 6 and a backwardly directed front face 24. The impact element 5 has a front face bearing forwardly against the front face 24 and a back face 8 and a wedge 12 is secured by a bolt 7 between the back face 8 and the face 6, which diverge radially outward. The back face 8 and complementary front face of the wedge 12 extend in a radial plane from the axis A.

Figure 3:
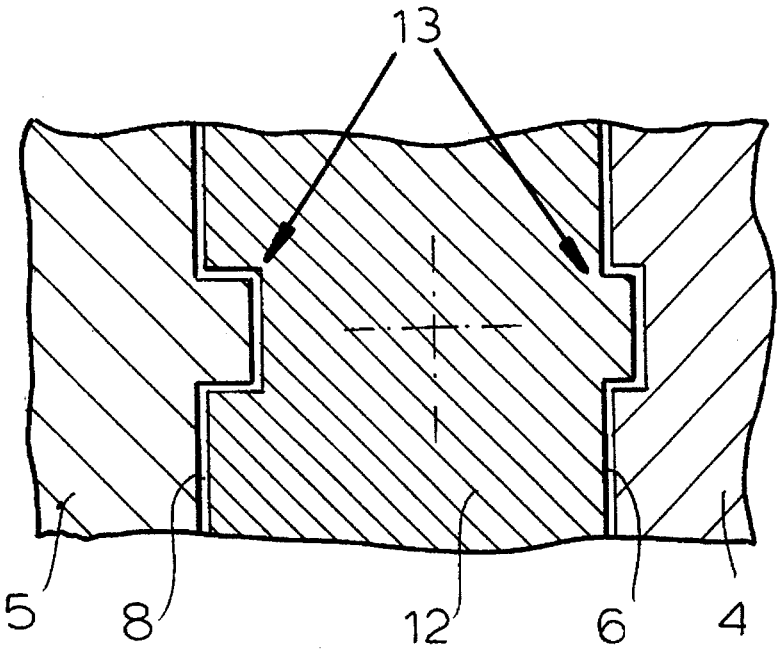
FIGS. 3 and 4 are sections taken along respective lines III—III and IV—IV of FIG. 2.
Figure 4:
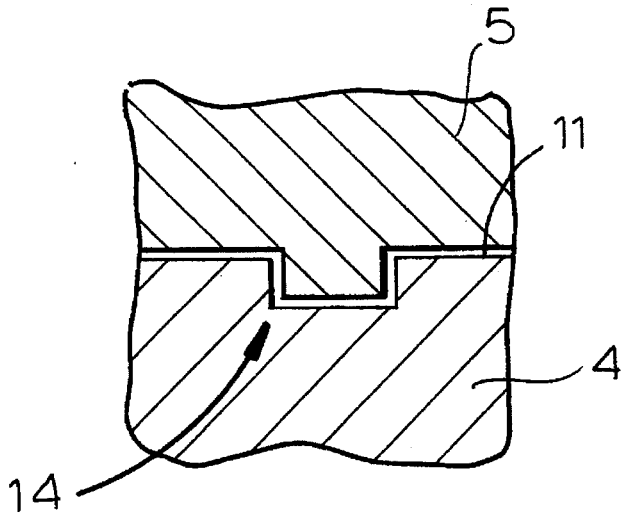

To lock the wedge 12 and element 5 axially in place, the interfaces to both sides of the wedge 12 are formed as shown in FIG. 3 with interfitting square ridge/groove formations 13 extending radially of the axis A. More particularly the front face of the wedge 12 and back face 6 of the pocket 11 are formed with rectangular-section grooves and the confronting faces are formed with complementary ridges. Similarly as shown in FIG. 4 the base of the element 5 and complementary base surface of the rotor 4 are formed with another such interfitting groove/ridge formation 14.

In addition the front face 24 of the pocket 11 is formed with a backwardly open and axially extending groove 15 into which fits a forwardly projecting ridge 16 formed on the front face of the element 5. This radially couples the element 5 directly to the rotor 4 so that not all radially outwardly created forces are effective on the wedge 12. In addition the front and back faces of the element 5 are formed outside the pocket 11, in fact radially past the outermost extent of the with axially extending weakening grooves 17. Thus if the element 5 does break, it will do so outside the pocket 11 to minimize damage to the rotor 4 and wedge 12.

Figure 5:
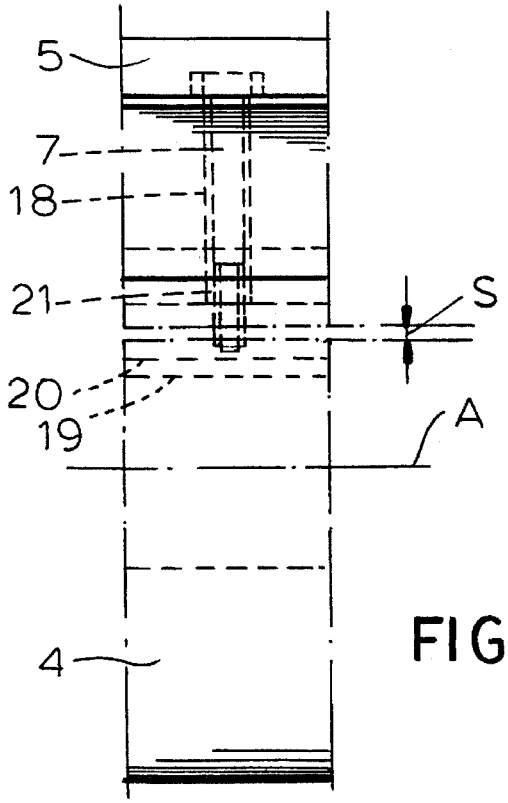
FIG. 5 is an end view taken in the direction of arrow V of FIG. 2.

The section 4 of the rotor 3 is formed offset from the axis A and underneath the wedge 12 with an axially throughgoing large-diameter hole 19 shown in FIGS. 2 and 5 that receives a smaller diameter rod 20 formed with a transverse threaded bore 22. The bolt 7 extends parallel to the back face 6 through a throughgoing bore 18 in the wedge 12 and a complementary hole 21 in the rotor 3 and is threaded into the bore 22 with the head of the bolt 7 bearing radially inward on the wedge 12. The rod 20 is received with some play S in the bore 19 so it can be removed and replaced easily.

With this system if the bolt 7 is badly damaged, the rod 20 can be punched out, shearing off the end of the bolt 7, and the bolt 7 can easily be removed. To this end the bolt 7 is also a loose fit in the bore 21.

We claim:

1. A rotary impact breaker comprising:

a housing;

a rotor rotatable in the housing about an axis in a predetermined direction and formed with a radially outwardly open pocket having a generally radially extending front and back faces respectively facing against and in the rotation direction;

an impact element having a foot part seated in the pocket and having a front face directed forward in the rotation direction and bearing against the front pocket face and a back face directed backward against the rotation direction and confronting and diverging from the back pocket face, and a head part projecting radially from the pocket;

a retaining wedge in the pocket behind the impact element relative to the rotation direction and having a front face bearing forward against the back impact element face and a back face bearing backward against the back pocket face; and a bolt engaging radially from the wedge into the rotor and pressing the wedge radially inward and thereby tightly lodging the wedge between the back impact element face and back pocket face.

2. The rotary impact breaker defined in claim 1 wherein the back pocket and wedge faces are formed with a radially extending and interengaging ridge and groove.

3. The rotary impact breaker defined in claim 1 wherein the front wedge and back impact element faces are formed with a radially extending and interengaging ridge and groove.

4. The rotary impact breaker defined in claim 1 wherein the pocket has a radially outwardly directed base face and the impact element has a base face radially inwardly engaging the pocket base faces, the base faces being formed with an angularly extending and interengaging ridge and groove.

5. The rotary impact breaker defined in claim 1 wherein the front pocket face is formed with a backwardly open undercut and the impact element is formed on its front face with a forwardly projecting ridge engaging in the undercut.

6. The rotary impact breaker defined in claim 1 wherein the impact element is formed radially outside the pocket with a weakening groove.

7. The rotary impact breaker defined in claim 6 wherein the weakening groove extends generally parallel to the axis and is cut into the front impact element face.

8. The rotary impact breaker defined in claim 1 wherein the rotor is formed radially inward of the wedge with an axially extending bore and with a radially extending bore between the axial bore and the pocket, the wedge being formed with a radially throughgoing bore aligned with the radial rotor bore, the rotor including an anchor rod loosely received in the axial bore and formed with a threaded bore aligned with the radial bores of the rotor and wedge, the bolt being engaged through the radial bores of the rotor and wedge and being threaded into the threaded bore of the anchor rod.

9. The rotary impact breaker defined in claim 1 wherein the rotor is a disk shaped with a spiral-shaped outer surface.

10. A rotary impact breaker comprising:

a housing;

a rotor rotatable in the housing about an axis in a predetermined direction, formed with a radially outwardly open pocket having generally radially extending front and back faces, and formed radially inward of the pocket with an axially extending bore and with a radially extending bore between the axial bore and the pocket;

an anchor rod loosely received in the axial bore and formed with a threaded bore aligned with the radial bore of the rotor;

an impact element having a foot part seated in the pocket and having a front face bearing against the front pocket face and a back face confronting and diverging from the back pocket face, and a head part projecting radially from the pocket;

a retaining wedge in the pocket having a front face bearing forward against the back impact element face and a back face bearing backward against the back pocket face and formed with a radially throughgoing bore aligned with the radial bore of the rotor; and a bolt engaging radially loosely through the bores of the wedge and of the rotor and into the axial bore of the rotor, threaded into the threaded bore of the rod, and pressing the wedge radially inward and thereby tightly lodging the wedge between the back impact element face and back pocket face.

* * * * *